US008578528B1

(12) United States Patent
Heare

(10) Patent No.: US 8,578,528 B1
(45) Date of Patent: Nov. 12, 2013

(54) ACCESSORY STORAGE SYSTEM

(76) Inventor: Greg Heare, New Oxford, PA (US)

( * ) Notice: Subject to any disclaimer, the term of this patent is extended or adjusted under 35 U.S.C. 154(b) by 0 days.

(21) Appl. No.: 13/467,978

(22) Filed: May 9, 2012

(51) Int. Cl.
*A47C 31/00* (2006.01)

(52) U.S. Cl.
USPC ..... 5/503.1; 5/507.1; 5/658; D6/512; 108/49

(58) Field of Classification Search
USPC ..... 5/503.1, 507.1, 508, 658; 211/13
See application file for complete search history.

(56) References Cited

U.S. PATENT DOCUMENTS

| | | | | |
|---|---|---|---|---|
| 2,557,674 | A * | 6/1951 | McRae | 248/95 |
| 4,008,808 | A | 2/1977 | Ramsay | |
| 4,483,501 | A * | 11/1984 | Eddy | 248/205.1 |
| 4,521,930 | A * | 6/1985 | Henson | 5/658 |
| 5,427,231 | A | 6/1995 | Willimann | |
| 5,605,235 | A * | 2/1997 | Johnson | 211/26.1 |
| 5,651,152 | A * | 7/1997 | Ritchie et al. | 5/503.1 |
| 5,727,693 | A | 3/1998 | Taylor | |
| D439,246 | S | 3/2001 | Hansen, Jr. | |
| 7,043,778 | B1 * | 5/2006 | Georgitsis et al. | 5/93.1 |
| 7,398,951 | B1 * | 7/2008 | Sugalski et al. | 248/311.2 |
| D618,675 | S | 6/2010 | Thompson et al. | |
| 2004/0261175 | A1 * | 12/2004 | May | 5/503.1 |
| 2008/0012536 | A1 | 1/2008 | Glass | |
| 2008/0132278 | A1 | 6/2008 | Dovey | |
| 2008/0185946 | A1 | 8/2008 | Meckert et al. | |

* cited by examiner

*Primary Examiner* — Robert G Santos
*Assistant Examiner* — Brittany Wilson

(57) ABSTRACT

An accessory storage system used with a mattress unit and a box springs unit. The system has a mounting member with a generally planar bed securing member and a generally planar storage securing member. The system has a storage member with a large storage cavity and a small storage cavity. The small storage cavity is located on the large storage cavity. For use, the mounting member is pivoted fully open to about a ninety degree angle. The bed securing member is fully inserted in between a mattress unit bottom surface and a box springs unit top surface. The back surface of the storage securing member is located flush against the mattress unit. The first large storage cavity side is located flush against the front surface of the storage securing member and held securely into place via the securing slots and the securing extensions.

5 Claims, 5 Drawing Sheets

ACCESSORY STORAGE SYSTEM

BACKGROUND OF THE INVENTION

Throughout the years, bedroom furniture has evolved to accommodate the needs of the occupant. Night stand surfaces are often used on which to set lighting devices and clocks, while shelves on head boards are frequently used for this purpose as well. In many bedrooms, mobile phones and tablet devices are often in use into the night along with traditional magazines or books. Because of the presence of these items in or around a bed, night stand and shelf surface space at bedtime is at a premium. The present invention features an accessory storage system for storage of remote control devices, mobile phones, tablet devices, books, and magazines.

SUMMARY

The present invention features an accessory storage system for storage of remote control devices, mobile phones, tablet devices, books, and magazines. In some embodiments, the system comprises a bed having a mattress unit and a box springs unit. In some embodiments, a mattress unit bottom surface is located on a box springs unit top surface.

In some embodiments, the system comprises a mounting member having a generally planar bed securing member and a generally planar storage securing member. In some embodiments, a third bed securing member side is pivotally attached to a third storage securing member side. In some embodiments, the storage securing member comprises a plurality of securing slots located therein.

In some embodiments, the system comprises a storage member having a large storage cavity and a small storage cavity.

In some embodiments, the first large storage cavity side comprises a plurality of securing extensions located thereon. In some embodiments, the securing extensions interface with and securely attach to the securing slots. In some embodiments, the large storage cavity comprises an aperture located on the large storage cavity bottom for which a mobile phone charger plug may pass through.

In some embodiments, the small storage cavity is located on the large storage cavity. In some embodiments, the small storage cavity top is located generally parallel to the large storage cavity top. In some embodiments, the small storage cavity comprises an aperture located on the small storage cavity bottom for which a mobile phone charger plug may pass through.

In some embodiments, for use, the mounting member is pivoted fully open to about a ninety degree angle. In some embodiments, the bed securing member is fully inserted in between the mattress unit bottom surface and the box springs unit top surface. In some embodiments, the back surface of the storage securing member is located flush against the mattress unit. In some embodiments, the storage member is located on the mounting member. In some embodiments, the first large storage cavity side is located flush against the front surface of the storage securing member and held securely into place via the securing slots and the securing extensions.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
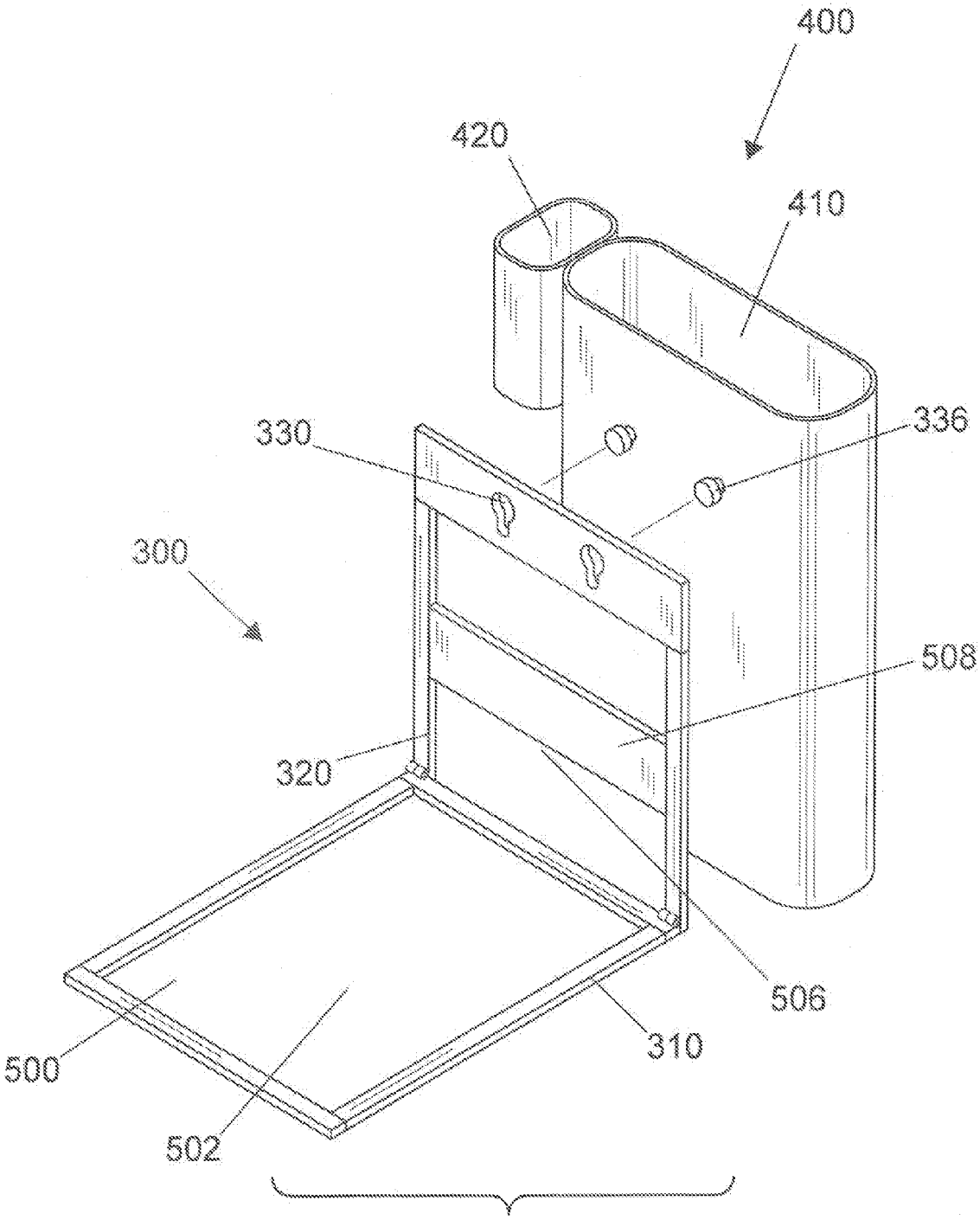
FIG. 1 is a perspective view of the present invention.
Figure 2:
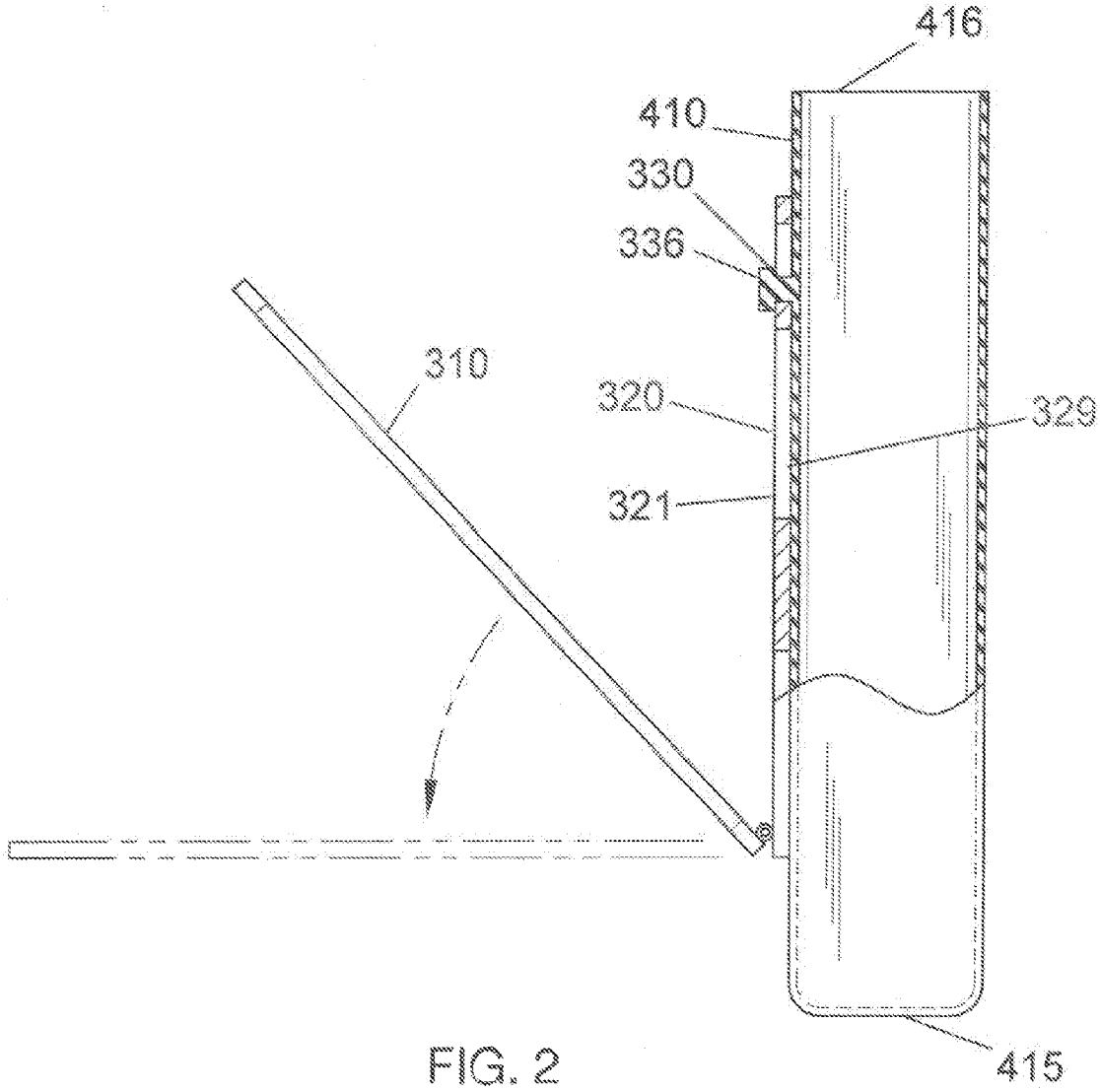
FIG. 2 is a side view of the present invention.
Figure 3:
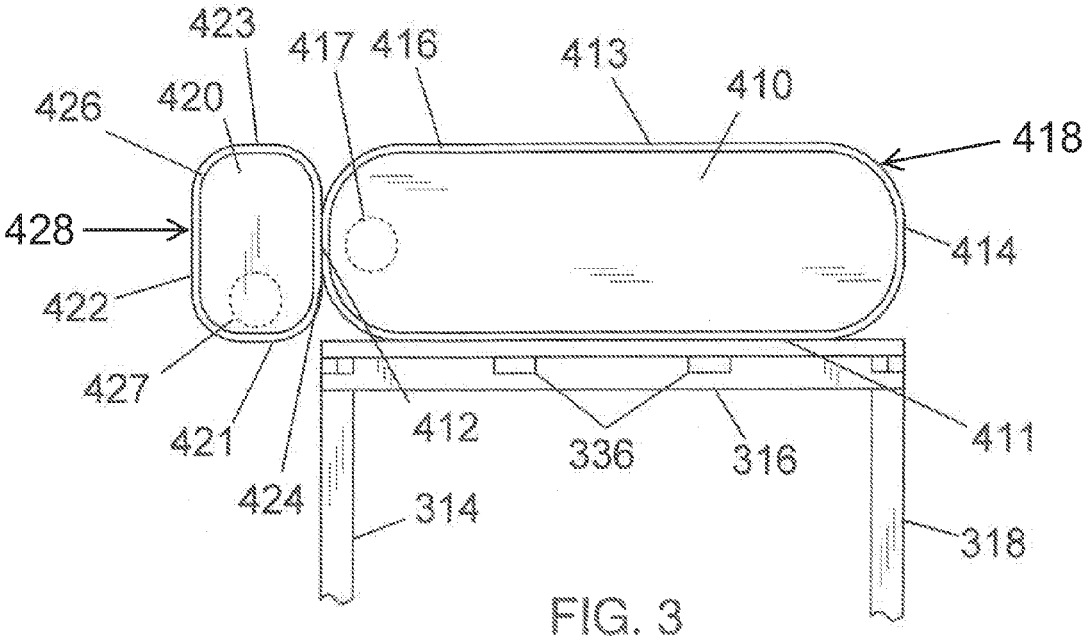
FIG. 3 is a top view of the present invention.
Figure 4:
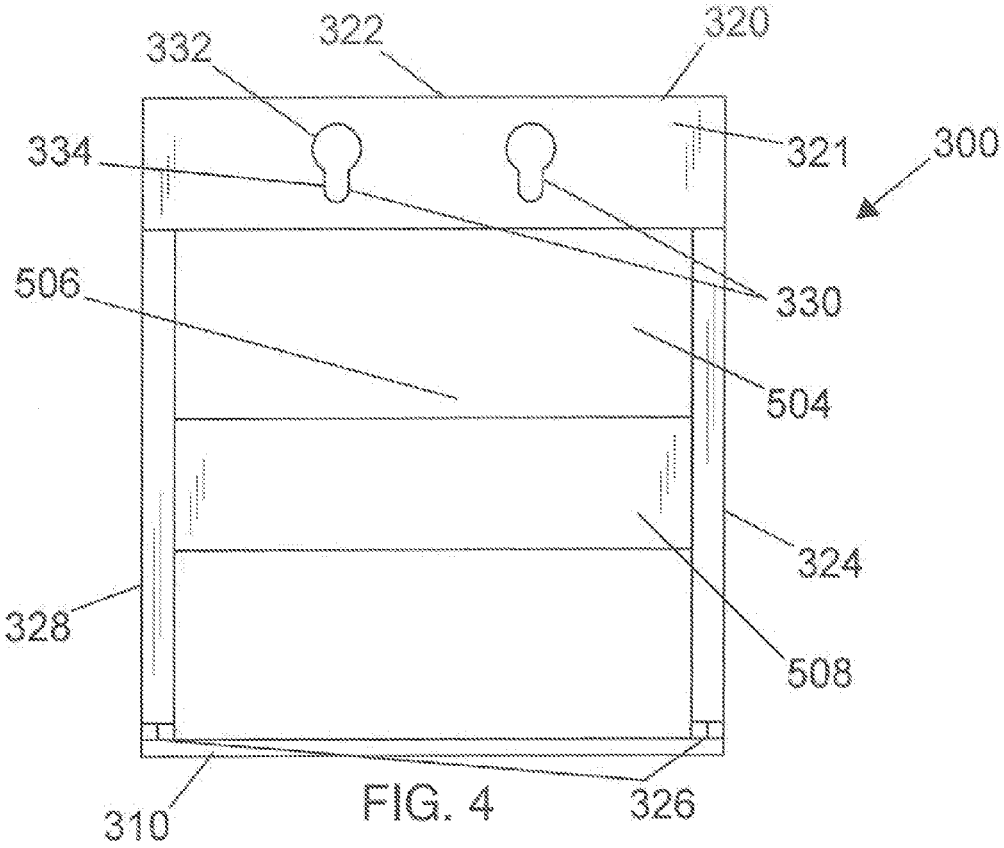
FIG. 4 is a rear view of the mounting member of the present invention.
Figure 5:
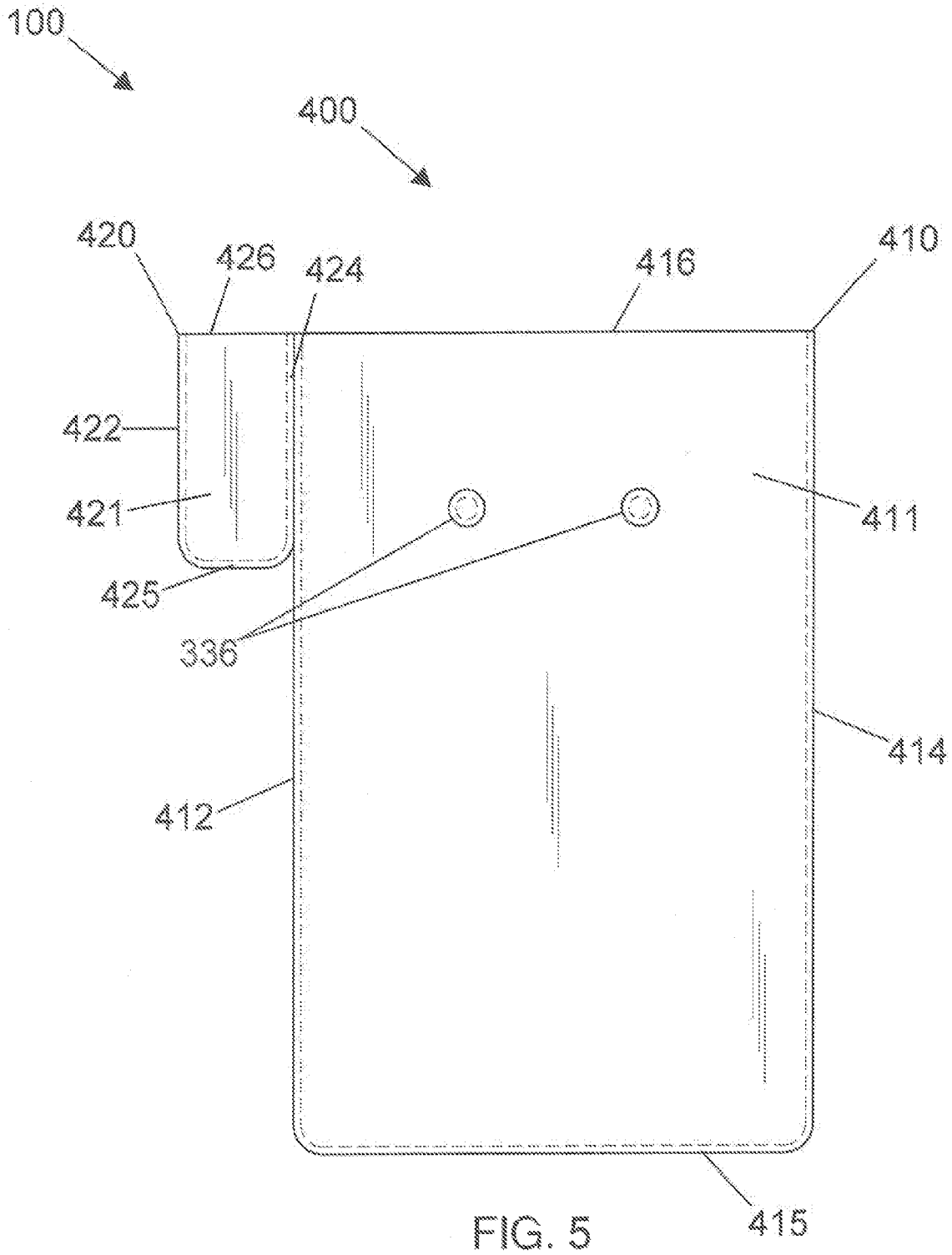
FIG. 5 is a rear view of the storage member of the present invention.
Figure 6:
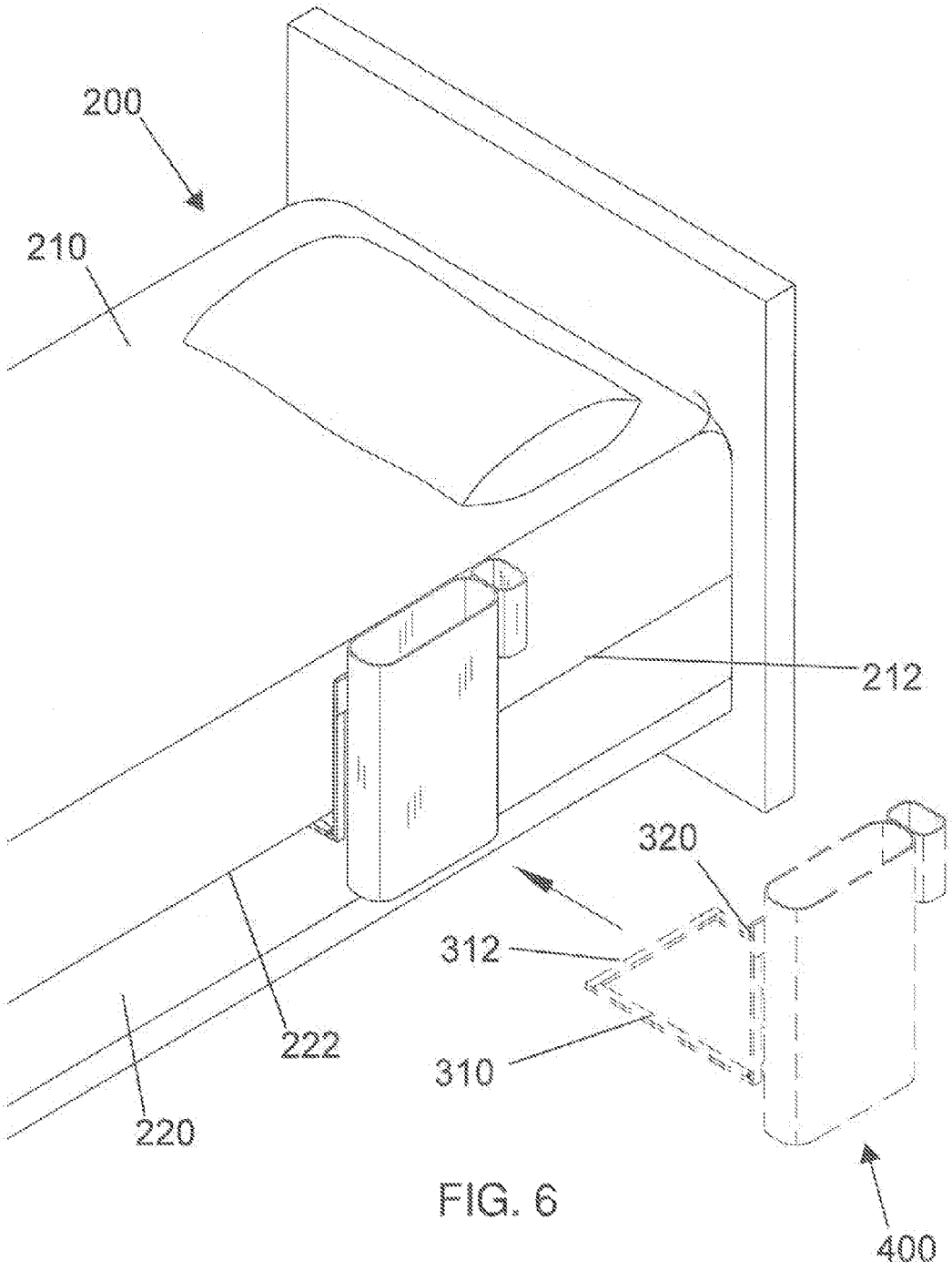
FIG. 6 is a perspective view of the present invention.

Following is a list of elements corresponding to a particular element referred to herein:

100 Accessory storage system
200 Bed
210 Mattress unit
212 Mattress unit bottom surface
220 Box springs unit
222 Box springs top surface
300 Mounting member
310 Bed securing member
312 First bed securing member side
314 Second bed securing member side
316 Third bed securing member side
318 Fourth bed securing member side
320 Storage securing member
321 Storage securing member back surface
322 First storage securing member side
324 Second storage securing member side
326 Third storage securing member side
328 Fourth storage securing member side
329 Storage securing member front surface
330 Securing slot
332 First slot diameter
334 Second slot diameter
336 Securing extension
400 Storage member
410 Large storage cavity
411 First large storage cavity side
412 Second large storage cavity side
413 Third large storage cavity side
414 Fourth large storage cavity side
415 Large storage cavity bottom
416 Large storage cavity top
417 Large storage cavity aperture
420 Small storage cavity
421 First small storage cavity side
422 Second small storage cavity side
423 Third small storage cavity side
424 Fourth small storage cavity side
425 Small storage cavity bottom
426 Small storage cavity top
427 Small storage cavity aperture
500 Bed securing member aperture
502 Bed securing member middle
504 Storage securing member aperture
506 Storage securing member middle
508 Support bar Referring now to FIG. 1-6, the present invention features an accessory storage system (100) for storage of remote control devices, mobile phones, tablet devices, books, and magazines. In some embodiments, the system (100) comprises a bed (200) having a mattress unit (210) and a box springs unit (220). In some embodiments, a mattress unit bottom surface (212) is located on a box springs top surface (222).

In some embodiments, the system (100) comprises a mounting member (300) having a generally planar bed securing member (310) and a generally planar storage securing member (320). In some embodiments, the bed securing member (310) comprises a first bed securing member side (312), a second bed securing member side (314), a third bed securing member side (316), and a fourth bed securing member side (318). In some embodiments, the storage securing member (320) comprises a first storage securing member side (322), a second storage securing member side (324), a third storage securing member side (326), and a fourth storage securing member side (328). In some embodiments, the third bed securing member side (316) is pivotally attached to the third storage securing member side (326).

In some embodiments, the storage securing member (320) comprises a plurality of securing slots (330) located therein. In some embodiments, the securing slot (330) is close to the first storage securing member side (322). In some embodiments, the securing slot (330) comprises a first slot diameter (332) and a second slot diameter (334). In some embodiments, the first slot diameter (332) is greater than the second slot diameter (334). In some embodiments, the first slot diameter (332) is located above, yet fluidly connected to the second slot diameter (334) with respect to a ground surface. In some embodiments, the first slot diameter (332) and the second slot diameter (334) together generally form an oval.

In some embodiments, the system (100) comprises a storage member (400) having a large storage cavity (410) and a small storage cavity (420). In some embodiments, the large storage cavity (410) comprises a first large storage cavity side (411), a second large storage cavity side (412), a third large storage cavity side (413), a fourth large storage cavity side (414), a large storage cavity bottom (415), and a large storage cavity top (416). In some embodiments, the first large storage cavity side (411), second large storage cavity side (412), third large storage cavity side (413), fourth large storage cavity side (414), and large storage cavity bottom (415) are fully enclosed forming a cavity having a fully open large storage cavity top (416).

In some embodiments, the first large storage cavity side (411) comprises a plurality of securing extensions (336) located thereon. In some embodiments, the securing extensions (336) are close to the large storage cavity top (416). In some embodiments, the securing extensions (336) interface with and securely attach to the securing slots (330). In some embodiments, the large storage cavity (410) comprises a large storage cavity aperture (417) located on the large storage cavity bottom (415) for which a mobile phone charger plug may pass through.

In some embodiments, the small storage cavity (420) comprises a first small storage cavity side (421), a second small storage cavity side (422), a third small storage cavity side (423), a fourth small storage cavity side (424), a small storage cavity bottom (425) and a small storage cavity top (426). In some embodiments, the first small storage cavity side (421), second small storage cavity side (422), third small storage cavity side (423), fourth small storage cavity side (424), and small storage cavity bottom (425) are fully enclosed forming a cavity having a fully open small storage cavity top (426).

In some embodiments, the small storage cavity (420) is located on the large storage cavity (410). In some embodiments, the fourth small storage cavity side (424) is located on the second large cavity side. In some embodiments, the small storage cavity top (426) is located generally parallel to the large storage cavity top (416). In some embodiments, the small storage cavity (420) comprises a small storage cavity aperture (427) located on the small storage cavity bottom (425) for which a mobile phone charger plug may pass through.

In some embodiments, for use, the mounting member (300) is pivoted fully open to about a ninety degree angle. In some embodiments, the mounting member is fixed into position in about a ninety degree angle. In some embodiments, the bed securing member (310) is fully inserted in between the mattress unit bottom surface (212) and the box springs top surface (222). In some embodiments, a storage securing member back surface (321) is located flush against the mattress unit (210). In some embodiments, the storage member (400) is located on the mounting member (300). In some embodiments, the first large storage cavity side (411) is located flush against a storage securing member front surface (329) and held securely into place via the securing slots (330) and the securing extensions (336).

In some embodiments, the bed securing member (310) comprises a bed securing member aperture (500) located in a bed securing member middle (502).

in some embodiments, the storage securing member (320) comprises a storage securing member aperture (504) located in a storage securing member middle (506).

In some embodiments, the storage securing member middle (506) comprises a support bar (508) located thereon. In some embodiments, the support bar (508) is located from the second storage securing member side (324) to the fourth storage securing member side (328).

As used herein, the term "about" refers to plus or minus 10% of the referenced number. For example, an embodiment wherein the member is about 10 inches in length includes a member that is between 9 and 11 inches in length.

The disclosures of the following U.S. patents are incorporated in their entirety by reference herein: U.S. Pat. No. D 618,675; U.S. Pat. No. D 439,246; U.S. Pat. Pub. No. 2008/0185946; U.S. Pat. Pub. No. 2008/0132278; U.S. Pat. Pub. No. 2008/0012536; U.S. Pat. No. 5,727,693; U.S. Pat. No. 5,427,231; U.S. Pat. No. 4,008,808.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An accessory storage system (100) for storage of remote control devices, mobile phones, tablet devices, books, and magazines wherein said system (100) comprises:

(a) a bed (200) having a mattress unit (210) and a box springs unit (220), wherein a mattress unit bottom surface (212) is disposed on a box springs top surface (222), (b) a mounting member (300) having a generally planar bed securing member (310) and a generally planar storage securing member (320), wherein the bed securing member (310) comprises a first bed securing member side (312), a second bed securing member side (314), a third bed securing member side (316), and a fourth bed securing member side (318), wherein the storage securing member (320) comprises a first storage securing member side (322), a second storage securing member side (324), a third storage securing member side (326), and a fourth storage securing member side (328), wherein the third bed securing member side (316) is pivotally attached to the third storage securing member side (326), wherein the storage securing member (320) comprises a plurality of securing slots (330) disposed therein, wherein the securing slot (330) is proximal to the first storage securing member side (322), wherein the securing slot (330) comprises a first slot diameter (332) and a second slot diameter (334), wherein the first slot diameter (332) is greater than the second slot diameter (334), wherein the first slot diameter (332) is disposed above, yet fluidly connected to the second slot diameter (334) with respect to a ground surface, wherein the first slot diameter (332) and the second slot diameter (334) together generally form an oval; and (c) a storage member (400) having a large storage cavity (410) and a small storage cavity (420), wherein the large storage cavity (410) comprises a first large storage cavity side (411), a second large storage cavity side (412), a third large storage cavity side (413), a fourth large storage cavity side (414), a large storage cavity bottom (415), and a large storage cavity top (416);

wherein the first large storage cavity side (411), second large storage cavity side (412), third large storage cavity side (413), fourth large storage cavity side (414), and large storage cavity bottom (415) are fully enclosed forming a cavity having a fully open large storage cavity top (416), wherein the first large storage cavity side (411) comprises a plurality of securing extensions (336) disposed thereon, wherein the securing extensions (336) are proximal to the large storage cavity top (416), wherein the securing extensions (336) interface with and securely attach to the securing slots (330);

wherein the large storage cavity (410) comprises a large storage cavity aperture (417) disposed on the large storage cavity bottom (415) for which a mobile phone charger plug may pass through;

wherein the small storage cavity (420) comprises a first small storage cavity side (421), a second small storage cavity side (422), a third small storage cavity side (423), a fourth small storage cavity side (424), a small storage cavity bottom (425) and a small storage cavity top (426), wherein the first small storage cavity side (421), second small storage cavity side (422), third small storage cavity side (423), fourth small storage cavity side (424), and small storage cavity bottom (425) are fully enclosed forming a cavity having a fully open small storage cavity top (426);

wherein the small storage cavity (420) is disposed on the large storage cavity (410), wherein the fourth small storage cavity side (424) is disposed on the second large storage cavity side (412), wherein the small storage cavity top (426) is disposed generally parallel to the large storage cavity top (416), wherein the small storage cavity (420) comprises a small storage cavity aperture (427) disposed on the small storage cavity bottom (425) for which a mobile phone charger plug may pass through, wherein the first, second, third, and fourth sides of both the small storage cavity (420) and the large storage cavity (410) are solid panels, wherein a first perimeter boundary (428) of the small storage cavity bottom (425) and a second perimeter boundary (429) the large storage cavity bottom (415) are continuous;

wherein for use, the mounting member (300) is pivoted fully open to about a ninety degree angle, wherein the bed securing member (310) is fully inserted in between the mattress unit bottom surface (212) and the box springs top surface (222), wherein a storage securing member back surface (321) is disposed flush against the mattress unit (210), wherein the storage member (400) is disposed on the mounting member (300), wherein the first large storage cavity side (411) is disposed flush against a storage securing member front surface (329) and held securely into place via the securing slots (330) and the securing extensions (336).

2. The system (100) of claim 1, wherein the bed securing member (310) comprises a bed securing member aperture (500) disposed in a bed securing member middle (502).

3. The system (100) of claim 1, wherein the storage securing member (320) comprises a storage securing member aperture (504) disposed in a storage securing member middle (506).

4. The system (100) of claim 3, wherein the storage securing member middle (506) comprises a support bar (508) disposed thereon, wherein the support bar (508) is disposed from the second storage securing member side (324) to the fourth storage securing member side (328).

5. An accessory storage system (100) for storage of remote control devices, mobile phones, tablet devices, books, and magazines wherein said system (100) consists of:

(a) a bed (200) having a mattress unit (210) and a box springs unit (220), wherein a mattress unit bottom surface (212) is disposed on a box springs top surface (222), (b) a mounting member (300) having a generally planar bed securing member (310) and a generally planar storage securing member (320), wherein the bed securing member (310) consists of a first bed securing member side (312), a second bed securing member side (314), a third bed securing member side (316), and a fourth bed securing member side (318), wherein the storage securing member (320) consists of a first storage securing member side (322), a second storage securing member side (324), a third storage securing member side (326), and a fourth storage securing member side (328), wherein the third bed securing member side (316) is pivotally attached to the third storage securing member side (326), wherein the storage securing member (320) consists of a plurality of securing slots (330) disposed therein, wherein the securing slot (330) is proximal to the first storage securing member side (322), wherein the securing slot (330) consists of a first slot diameter (332) and a second slot diameter (334), wherein the first slot diameter (332) is greater than the second slot diameter (334), wherein the first slot diameter (332) is disposed above, yet fluidly connected to the second slot diameter (334) with respect to a ground surface, wherein the first slot diameter (332) and the second slot diameter (334) together generally form an oval; and (c) a storage member (400) having a large storage cavity (410) and a small storage cavity (420), wherein the large storage cavity (410) consists of a first large storage cavity side (411), a second large storage cavity side (412), a third large storage cavity side (413), a fourth large storage cavity side (414), a large storage cavity bottom (415), and a large storage cavity top (416);

wherein the first large storage cavity side (411), second large storage cavity side (412), third large storage cavity side (413), fourth large storage cavity side (414), and large storage cavity bottom (415) are fully enclosed forming a cavity having a fully open large storage cavity top (416), wherein the first large storage cavity side (411) consists of a plurality of securing extensions (336) disposed thereon, wherein the securing extensions (336) are proximal to the large storage cavity top (416), wherein the securing extensions (336) interface with and securely attach to the securing slots (330);

wherein the large storage cavity (410) consists of a large storage cavity aperture (417) disposed on the large storage cavity bottom (415) for which a mobile phone charger plug may pass through;

wherein the small storage cavity (420) consists of a first small storage cavity side (421), a second small storage cavity side (422), a third small storage cavity side (423), a fourth small storage cavity side (424), a small storage cavity bottom (425) and a small storage cavity top (426), wherein the first small storage cavity side (421), second small storage cavity side (422), third small storage cavity side (423), fourth small storage cavity side (424), and small storage cavity bottom (425) are fully enclosed forming a cavity having a fully open small storage cavity top (426);

wherein the small storage cavity (420) is disposed on the large storage cavity (410), wherein the fourth small storage cavity side (424) is disposed on the second large storage cavity side (412), wherein the small storage cavity top (426) is disposed generally parallel to the large storage cavity top (416), wherein the small storage cavity (420) consists of a small storage cavity aperture (427) disposed on the small storage cavity bottom (425) for which a mobile phone charger plug may pass through, wherein the first, second, third, and fourth sides of both the small storage cavity (420) and the large storage cavity (410) are solid panels, wherein a first perimeter boundary (428) of the small storage cavity bottom (425) and a second perimeter boundary (429) the large storage cavity bottom (415) are continuous;

wherein for use, the mounting member (300) is pivoted fully open to about a ninety degree angle, wherein the bed securing member (310) is fully inserted in between the mattress unit bottom surface (212) and the box springs top surface (222), wherein a storage securing member back surface (321) is disposed flush against the mattress unit (210), wherein the storage member (400) is disposed on the mounting member (300), wherein the first large storage cavity side (411) is disposed flush against a storage securing member front surface (329) and held securely into place via the securing slots (330) and the securing extensions (336).

* * * * *